US006446792B1

(12) United States Patent
Kaniaris, Jr.

(10) Patent No.: US 6,446,792 B1
(45) Date of Patent: Sep. 10, 2002

(54) MOVABLE STORAGE UNIT AND PLUNGER COMBINATION WITH OTHER OPTIONAL TOILET ACCESSORIES SUCH AS BRUSH

(76) Inventor: John Kaniaris, Jr., 7577 Central Park Blvd., Suite 302, Mason, OH (US) 45040

( * ) Notice: Subject to any disclaimer, the term of this patent is extended or adjusted under 35 U.S.C. 154(b) by 0 days.

(21) Appl. No.: 09/802,298

(22) Filed: Mar. 8, 2001

(51) Int. Cl.[7] ..... A45D 44/18
(52) U.S. Cl. ..... 206/15.3; 206/361
(58) Field of Search ..... 206/361, 362.2, 206/362.3, 15.2, 15.3, 581, 225, 349; 220/736; 4/255.05, 255.11; D6/551, 525

(56) References Cited

U.S. PATENT DOCUMENTS

| | | | | |
|---|---|---|---|---|
| 2,423,292 A | | 7/1947 | Brown | |
| 2,464,085 A | | 3/1949 | Hess | |
| D161,014 S | | 11/1950 | Gerson | |
| 2,697,646 A | | 12/1954 | Craig | |
| 3,361,507 A | | 1/1968 | O'Neil | |
| 4,008,933 A | | 2/1977 | Wanek | |
| 4,432,451 A | | 2/1984 | Hooser | |
| D272,874 S | | 3/1984 | Cohen | |
| 4,458,368 A | | 7/1984 | Webb | |
| D292,631 S | | 11/1987 | Tash | |
| 4,887,713 A | | 12/1989 | Tupper | |
| 5,353,442 A | | 10/1994 | Rotter | |
| D356,893 S | | 4/1995 | Conmy | |
| 5,456,356 A | | 10/1995 | Kurzawa | |
| 5,595,303 A | | 1/1997 | Weeks et al. | |
| 5,640,722 A | | 6/1997 | Bui | |
| 5,924,566 A | * | 7/1999 | Gibbs | 206/361 |
| 5,958,150 A | | 9/1999 | Borger et al. | |
| 5,971,141 A | | 10/1999 | Shafik | |
| 5,984,100 A | | 11/1999 | Ramsey et al. | |
| 6,038,709 A | * | 3/2000 | Kent | 4/255.05 |

* cited by examiner

*Primary Examiner*—Shian Luong
(74) *Attorney, Agent, or Firm*—Eric W. Guttag; Smith, Guttag, Hasse & Nesbitt, Ltd.

(57) ABSTRACT

A movable storage unit and toilet plunger combination that preferably includes a second toilet accessory such as a toilet brush. The storage unit has an elongated receptacle with an upper end for receiving the plunger and a cover having an aperture therein for releasably receiving a resilient connector. The connector has a bore with an inner wall extending through the connector to releasably secure the handle of the plunger to the connector so that a portion of the handle extends above the connector and the cover. The connector can also have formed therein holders for releasably securing and suspending the second toilet accessory within the receptacle.

13 Claims, 2 Drawing Sheets

MOVABLE STORAGE UNIT AND PLUNGER COMBINATION WITH OTHER OPTIONAL TOILET ACCESSORIES SUCH AS BRUSH

TECHNICAL FIELD OF THE INVENTION

The present application relates to a movable storage unit and toilet plunger combination that takes up minimal horizontal storage space in the bathroom, is of fairly simple design and permits ready access to the plunger. The present application further relates to a storage unit and plunger combination that provides the ability to conveniently store additional toilet accessories such as a toilet brush.

BACKGROUND OF THE INVENTION

A variety of toilet accessories are common to bathrooms. One such accessory is the toilet plunger. Toilet plungers have long been used to unblock drains and typically comprise a long handle attached to a flexible or elastomeric plunger cup. Such toilet plungers are difficult to store because of the limited amount of space in most bathrooms. In addition, toilet plungers are unsightly and unsanitary. Yet the toilet plunger should be readily available when necessary to remove blockages in the drains.

Besides plungers, other toilet accessories are frequently used in cleaning the bathroom. Once such accessory is the toilet brush. Toilet brushes typically have a head of fibers or bristles, a shank carrying the head and a handle attached to the shank. Like the plunger, the toilet brush can unsightly and unsanitary following use and can present problems in storing. Also like the plunger, the toilet brush should be readily available for use.

Devices for storing toilet plungers are known in the art. See, for example, U.S. Pat. No. 5,958,150 (Borger et al), issued Sep. 28, 1999, which discloses a device for storing and cleaning a toilet plunger. See also U.S. Pat. No. 4,432,451 (Hooser), issued Feb. 21, 1984 and U.S. Pat. No. 5,456,356 (Kurzawa), issued Oct. 10, 1995, which disclose devices for storing toilet tissue in addition to the plunger. Devices for storing toilet brushes are also known in the art. See U.S. Pat. No. 3,361,507 (O'Neil), issued Jan. 2, 1968 (brush and holder assembly); U.S. Pat. 2,464,085 (Hess), issued Mar. 8, 1949 (toilet brush container); U.S. Pat. No. 2,697,646 (Craig), issued Dec. 21, 1954 (utility cabinet for storing toilet brush).

There are also devices known in the art for storing both the toilet plunger and brush. One example is a plunger and brush dispensing toilet cover disclosed in U.S. Pat. No. 5,640,722 (Bui), issued Jun. 24, 1997. As shown in FIGS. 1 and 2 of this patent, the plunger and brush dispensing toilet cover 10 includes a plunger template 38 having a centrally formed aperture with small slits 39 extending radially outwardly that is releasably attached to handle 16 of plunger 12. As also shown in FIGS. 1 and 3 of this patent, toilet cover 10 further includes a similar toilet brush 10 template 40 having a centrally formed aperture with small slits 42 extending radially outwardly that is releasably attached to handle 18 of brush 22. The combination of templates 38/40 and plunger/brush 12/22 are inserted into cutouts 28 and 32, respectively, of tank cover 24 of the toilet reservoir 36 for storage. The disadvantages of the Bui device is its complexity, the need to alter the toilet itself to provide for storage of the plunger and brush and the inability to move the storage unit for the plunger and brush to other locations in the bathroom.

Another example is the toilet accessory kit disclosed in U.S. Pat. No. 5,971,141 (Shafik), issued Oct. 26, 1999. As shown in FIG. 1 of this patent, this kit 10 has a base member 11 provided with a cupped shaped receptacle 13 for head 31 of brush 30, and a divider handle 20 that divides the receptacle into two sections, one of which receives the cup 51 of plunger 50. A cover C is preferably placed over the base member 11 to enclose the brush, handle and plunger, with only the end portion 26A of the handle extending through the cover. Again, the Shafik device is of fairly complex construction, has a somewhat unusual configuration that may make it less aesthetically pleasing and may also create problems in terms of horizontal storage space in the bathroom because of the amount of horizontal space base member 11 takes up.

Yet another example is the bathroom accessory disclosed in U.S. Pat. No. 4,008,933 (Wanek), issued Feb. 22, 1977. As shown in FIG. 2 of this patent, accessory 10 has a centrally spaced housing 13 for receiving the cup end 13 of the plunger and a central spindle 18 for receiving the handle end 17 of the plunger and for storing rolls of toilet tissue 19. On either side of housing 13 are adjacent housing 26 for storing soap 32 and adjacent housing 37 for storing brush 40 that is provided with a hook 39 to suspend the brush. Again, the Wanek accessory is fairly complex, may make it difficult to readily access the plunger, and may create problems in terms of horizontal storage space in the bathroom because of the amount of horizontal space it takes up.

Accordingly, it would be desirable to provide the ability to store the plunger in a movable unit that takes up minimal horizontal storage space, is of fairly simple design, is aesthetically pleasing and permits ready access to the plunger, as well as providing the ability to conveniently store additional toilet accessories such as a toilet brush.

SUMMARY OF THE INVENTION

The present invention relates to a movable storage unit and toilet plunger combination. This combination comprises:

(a) a toilet plunger having an elongated handle and a plunger cup attached to the handle;

(b) a movable storage unit having an elongated receptacle with an open upper end for receiving the plunger and a cover that fits over the upper end of the receptacle and has an aperture formed therein for releasably receiving a connector, the receptacle having a base and a sidewall extending upwardly from the base to the open upper end of the receptacle, the sidewall having a height less than the length of the plunger such that a portion of the plunger handle extends above the storage unit and width greater than the width of the plunger cup so that the plunger cup fits within the receptacle;

(c) a resilient connector having a lower end and an upper end, an outer surface configured to be received by the aperture so as to be releasably secured to the cover, and a bore with an inner wall extending through the connector from the lower to the upper end thereof, the inner wall having a width relative to the width of the plunger handle such that the handle can be releasably secured to the connector and wherein the portion of the handle extends above the upper end of the connector.

In a preferred embodiment of the present invention, the storage unit and plunger combination further comprises a second toilet accessory having a handle such as a brush that is sized and configured to fit within the receptacle. In this preferred embodiment, the connector preferably includes at least one holder for releasably securing the handle of the second toilet accessory.

The present invention provides several advantages over prior devices for storing plungers, and especially devices that store additional toilet accessories (e.g., a toilet brush) besides the plunger. It is relatively mobile so that it can be moved to various locations in or out of the bathroom. It takes up minimal horizontal storage space so that it can be used even in relatively small and crowded bathrooms. It can also be aesthetically pleasing and permits ready access to the plunger by simply grasping the portion of the handle extending above the storage unit.

DETAILED DESCRIPTION OF THE INVENTION

Figure 1:
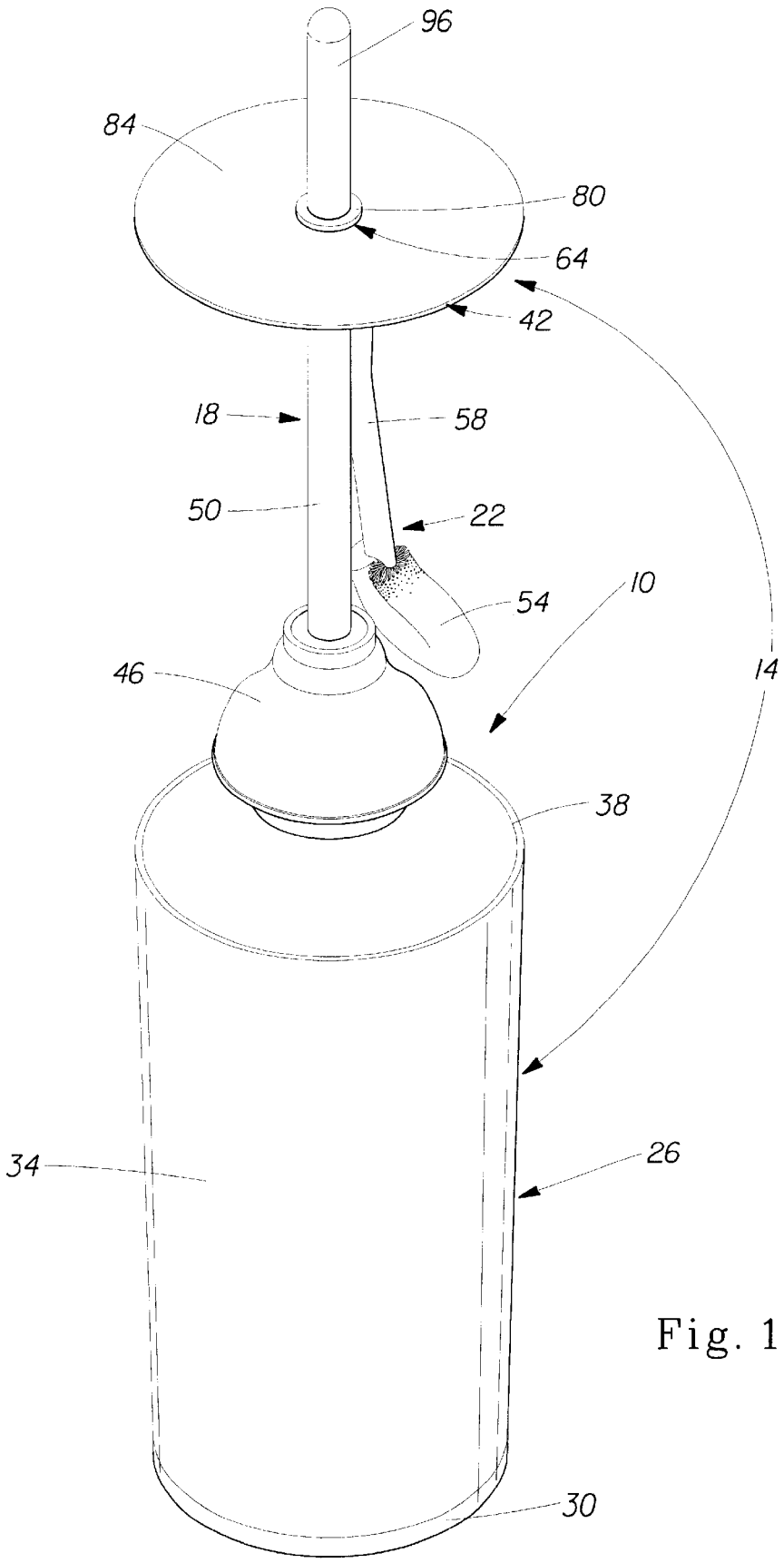
FIG. 1 is an exploded view of an embodiment of the present invention with the storage unit, plunger and toilet brush combination.

Referring to the drawings, FIG. 1 illustrates an exemplary embodiment of the device or combination of the present invention referred to generally as 10. Device 10 includes a storage unit indicated generally as 14, a toilet plunger indicated generally as 18 and optionally, but preferably, a second toilet accessory such as a toilet brush indicated generally as 22. Storage unit 14 is comprised of a receptacle 26 having a generally circular base 30 and a generally cylindrical sidewall 34 extending upwardly from base 30 to open upper end 38. Storage unit 14 is further comprised of a generally circular cover or lid 42 that fits onto the open upper end 38 of sidewall 34 of receptacle 26. For aesthetic purposes, it is preferred that receptacle 26 and cover 42 be made of a material that is opaque.

Plunger 18 can be of a conventional type and is comprised of an elastomeric or resilient plunger cup 46 and an elongated generally cylindrical handle 50 having one end attached to or inserted into cup 46. For aesthetic purposes, it is preferred that handle 50 be made of a material that is transparent or clear. Toilet brush 22 can also be of a conventional type and is comprised of a brush portion 54 and an elongated handle 58 having one attached to brush portion 54.

Because of the circular cross section of cup 46, base 30 preferably has a circular shape and sidewall 34 preferably has a cylindrical shape for ease of manufacture. However, the cross section of the sidewall 34 and base 30 can be of other shapes such as oval or elliptical, square and rectangular, so long as the width of sidewall 34 is greater than the width of cup 46 so that plunger 18 fits comfortably and easily within receptacle 26.

Figure 2:
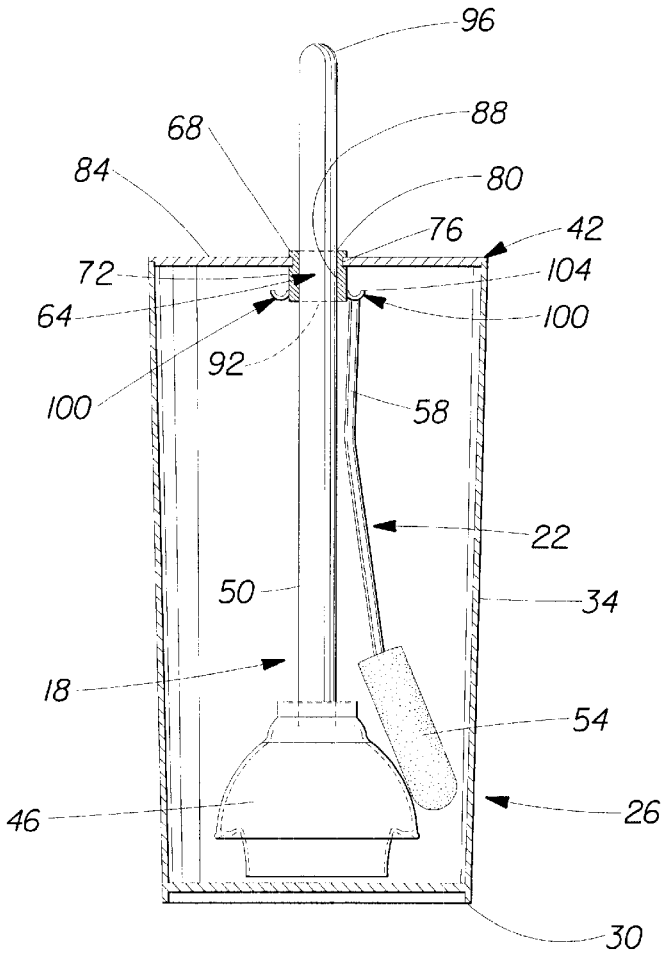
FIG. 2 is a side sectional view of the embodiment of FIG. 1.
Figure 3:
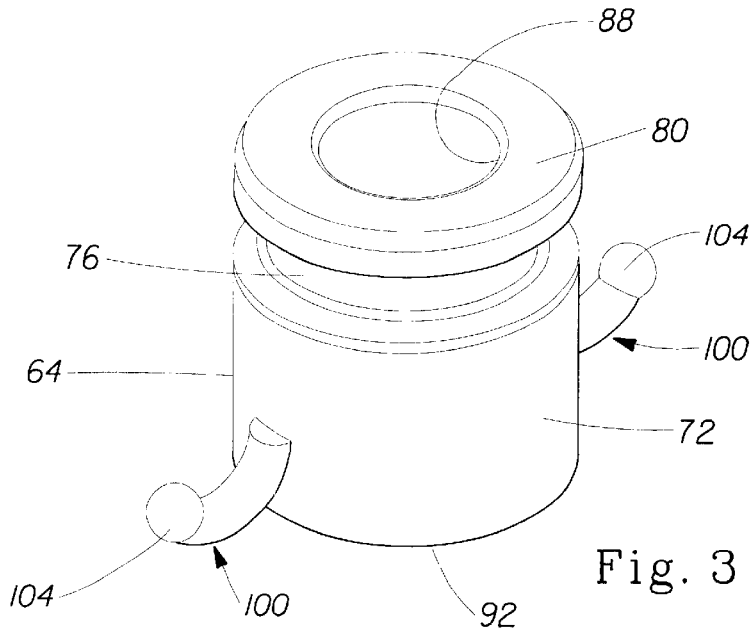
FIG. 3 is an enlarged view in perspective of the preferred connector used in the present invention.

As shown in FIG. 2 and particularly FIG. 3, device 10 further includes a resilient or flexible connector indicated generally as 64 that is made of a resilient or flexible material such as plastic or rubber and is releasably secured to cover 42. For this purpose, cover 42 has a circular aperture or hole 68 formed therein proximate the center of cover 42. The generally cylindrical outer surface 72 of connector 64 has formed therein a circular recess in the form of slot 76 having a diameter configured such that is received releasably but snugly within hole 68 of cover 42. At the upper end of connector 64 is an annular lip 80 that fits over the upper surface 84 of cover 42 at the edge of hole 68. Connector 64 has also formed therein a cylindrical bore having an inner surface 88 that extends through connector 64 from the lower end 92 to lip 80 at the upper end thereof. Inner surface 88 of connector 64 receives releasably but snugly handle 50 of plunger 18. As shown in FIG. 2, the end portion 96 of handle 50 extends above lip 80 of connector 64 so that portion 96 also extends above cover 42 and thus above storage unit 26.

As shown in FIGS. 2 and 3, connector 64 can have formed therein at least one holder in the form of a pair of hooks or prongs 100 that are on opposite sides of connector 64. As shown particularly in FIG. 3, each of the hooks 100 have ends 104 that extend outwardly and upwardly from outer surface 72. While connector 64 is shown with two such hooks 100, one hook or more than two hooks can be formed therein depending on what is desired. Also, the particularly shape of hooks 100 can be varied. For example, instead of the upwardly extending prongs shown in FIGS. 2 and 3, hooks 100 can be in the form of notches where a portion of connector 64 protrudes outwardly therefrom. As shown in FIG. 2, the purpose of hooks 100 is for releasably securing and suspending brush 22 within receptacle 26. An aperture or hole (not shown) is typically formed in handle 58 so that this hole can fit over the end 104 of one of the hooks 100. If desired, handle 58 can also be configured so that it would clip onto handle 50 of plunger 18 and thus be releasably secured until needed.

While specific embodiments of the present invention have been described, it will be apparent to those skilled in the art that various modifications thereto can be made without departing from the spirit and scope of the present invention as defined in the appended claims.

What is claimed is:

1. A movable storage unit and toilet plunger combination, which comprises:

(a) a toilet plunger having an elongated handle and a plunger cup attached to the plunger handle;

(b) a movable storage unit having an elongated receptacle with an open upper end for receiving the plunger and a cover that fits over the upper end of the receptacle and has aperture formed therein for releasably receiving a connector, the receptacle having a base and a sidewall extending upwardly from the base to the open upper end of the receptacle, the sidewall having a height less than the length of the plunger such that a portion of the plunger handle extends above the storage unit and width greater than the width of the plunger cup so that the plunger cup fits within the receptacle;

(c) a resilient connector having a lower end and an upper end, an outer surface configured to be received by the aperture so as to be releasably secured to the cover, and a bore with an inner wall extending through the connector from the lower to the upper end thereof, the inner wall having a width relative to the width of the plunger handle such that the plunger handle can be releasably secured to the connector and wherein the portion of the plunger handle extends above the upper end of the connector.

2. The combination of claim 1 wherein the base has a generally circular shape and the sidewall has a generally cylindrical shape.

3. The combination of claim 2 wherein the receptacle and cover are opaque and wherein the plunger handle is transparent.

4. The combination of claim 2 wherein the aperture is formed proximate the center of the cover.

5. The combination of claim 4 wherein the upper end of the connector has a lip that fits over the cover adjacent the aperture, wherein the outer surface of the connector has a generally cylindrical shape and wherein a generally circular slot is formed in the outer surface adjacent the lip that is configured to be releasably secured within the aperture of the cover.

6. The combination of claim 5 wherein the plunger handle is generally cylindrical in shape and wherein the inner wall of the bore is generally cylindrical in shape.

7. The combination of claim 5 wherein the connector has formed therein at least one holder for releasably securing a second toilet accessory.

8. The combination of claim 7 wherein the at least one holder comprises a pair of hooks, each hook being on opposite sides of the connector and having an end extending outwardly and upwardly from the outer surface of the connector.

9. The combination of claim 8 which further comprises a second toilet accessory having a handle, the accessory handle having an aperture formed therein that fits over the end of one of the hooks so that the second toilet accessory is suspended within the receptacle.

10. The combination of claim 9 wherein the second toilet accessory is a toilet brush having a brush portion attached to one end of the accessory handle.

11. A movable storage unit, toilet plunger and toilet brush combination, which comprises:

(a) a toilet plunger having an elongated generally cylindrical handle and a plunger cup attached to one end of the handle;

(b) a toilet brush having a brush portion and an elongated handle attached at one end to the brush portion, the brush handle having an aperture former therein;

(c) a movable storage unit having an elongated receptacle with an open upper end for receiving the plunger and a generally circular cover that fits over the upper end of the receptacle and has a circular hole formed therein proximate the center of the cover for releasably receiving a connector, the receptacle having a generally circular base and a generally cylindrical sidewall extending upwardly from the base to the open upper end of the receptacle, the sidewall having a height less than the length of the plunger such that a portion of the plunger handle extends above the storage unit and width greater than the width of the plunger cup so that the plunger cup fits within the receptacle;

(d) a resilient connector having a lower end and a lip at the upper end thereof, an outer generally cylindrical outer surface with a generally circular slot formed therein adjacent the lip and configured to be received by the hole so as to be releasably secured to the cover, a bore with a generally cylindrical inner wall extending through the connector from the lower end to the lip, the inner wall having a diameter relative to the diameter of the of the plunger handle such that the plunger handle can be releasably secured to the connector and wherein the portion of the plunger handle extends above the lip of the connector, and at least one hook formed in the connector for receiving the hole in the brush handle to suspend the brush within the receptacle.

12. The combination of claim 11 wherein the receptacle and cover are opaque and wherein the plunger handle is transparent.

13. The combination of claim 11 wherein the at least one hook comprises a pair of hooks, each hook being on opposite sides of the connector and having an end extending outwardly and upwardly from the outer surface of the connector.

* * * * *